United States Patent [19]

Mouissie

[11] Patent Number: 4,872,848

[45] Date of Patent: Oct. 10, 1989

[54] COVER FOR A MULTIPOINT CONNECTOR

[75] Inventor: Bob Mouissie, Berlicum, Netherlands

[73] Assignee: E. I. Du Pont de Nemours and Company, Wilmington, Del.

[21] Appl. No.: 266,892

[22] Filed: Nov. 3, 1988

[30] Foreign Application Priority Data

Nov. 9, 1987 [DE] Fed. Rep. of Germany ... 8714913[U]

[51] Int. Cl.[4] ..... H01R 13/44

[52] U.S. Cl. ..... 439/135; 439/367; 439/521

[58] Field of Search ..... 439/83, 135, 147, 148, 439/367, 521, 750, 892

[56] References Cited

U.S. PATENT DOCUMENTS

| | | | |
|---|---|---|---|
| 4,634,207 | 1/1987 | Debbaut | 439/521 |
| 4,740,169 | 4/1988 | Gordon | 439/521 |
| 4,744,143 | 5/1988 | Sadigh-Behzadi | 439/135 |
| 4,795,354 | 1/1989 | Owen | 439/135 |

FOREIGN PATENT DOCUMENTS

| | | | |
|---|---|---|---|
| 0060644 | 9/1982 | European Pat. Off. | 439/135 |
| 81/01773 | 6/1981 | PCT Int'l Appl. | 439/367 |

*Primary Examiner*—P. Austin Bradley

[57] ABSTRACT

Cover for a multipoint connector which comprises a block-shaped multipoint connector body. In said body contacts are provided in spaces. Said contacts are accessible from outside via apertures opening out in a lateral surface of the body. The cover comprises an upper part and four lateral parts extending virtually perpendicularly to it. Those surfaces of the lateral parts of the cover which face the apertures of the multipoint connector body are provided with knobs which lie opposite the apertures when the cover has been placed on and rest with their outer surface against the edge of the respective apertures.

8 Claims, 3 Drawing Sheets

COVER FOR A MULTIPOINT CONNECTOR

BACKGROUND OF THE INVENTION

The invention relates to a cover for a multipoint connector which comprises a block-shaped multipoint connector body with spaces in which contacts accessible from outside via apertures opening out in a lateral surface of the body are provided.

In vehicle technology multipoint connectors, electronic components and circuits are immersed in a protective lacquer. This lacquer protects the parts and circuits against oxidation and salt solutions which can penetrate into the spaces in which these circuits and lower are arranged.

The lacquer has the property of completely covering the multipoint connector bodies mounted on a printed circuit board. However, the disadvantage is produced that the protective lacquer penetrates through the apertures of the multipoint connector body and is deposited on the contact surfaces. As a result, the multipoint connectors are not reliable in use.

SUMMARY OF THE INVENTION

The object of the invention is to eliminate the said disadvantages.

This object is achieved in that the cover comprises an upper part and four lateral parts extending virtually perpendicularly to it, in that those surfaces of the lateral parts of the cover which face the apertures of the multipoint connector body are provided with knobs which lie opposite the apertures when the cover has been placed on and rest with their outer surface against the edge of the respective apertures.

The knobs cover the apertures of the multipoint connector body as good as possible, thus making it difficult for the lacquer to reach the contact surfaces.

If the inner surface of at least one of the apertures decreases in a pyramid-shape the edge of the latter from the lateral surface of the body, the corresponding knob has the shape of a truncated pyramid. Reliable sealing of the apertures is thereby achieved.

However, it is also possible that at least one of the apertures of the multipoint connector body has a rectangular or square cross-section and the connecting pin of the corresponding contact has been bent downwards virtually perpendicularly and lies in a slot in the aperture edge, the knob being of dome-shaped design.

According to one embodiment of this knob, the dome is provided with a projection which extends in the direction of the cover openings and is lower than the dome. By virtue of this projection, the said slot of the multipoint connector body is sealed in an optimum manner.

In a preferred embodiment, the projection has a trapezoidal cross-section and has been bevelled at the free end, this projection being provided at its free end with a second projection extending in the direction of the cover opening and having a curved cross-section.

The upper part of the cover is preferably at a distance from the free end which is greater than the height of the multipoint connector body. It is advantageous here that the lateral parts of the cover have been rounded at the free edge.

As a result, when the cover is pressed onto the multipoint connector body, said cover is pressed outwards slightly and the projections rest very tightly against the connecting pins.

BRIEF DESCRIPTION OF THE DRAWINGS

The invention is explained below with reference to preferred embodiments of the invention, which are shown in the drawings, in which.

DETAILED DESCRIPTION OF THE INVENTION

Figure 1:
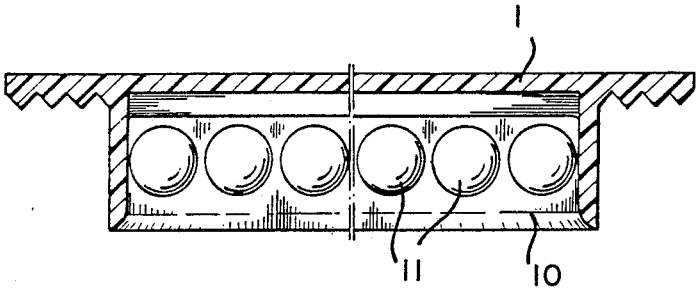
FIG. 1 shows a section through a cover according to the invention.
Figure 2:
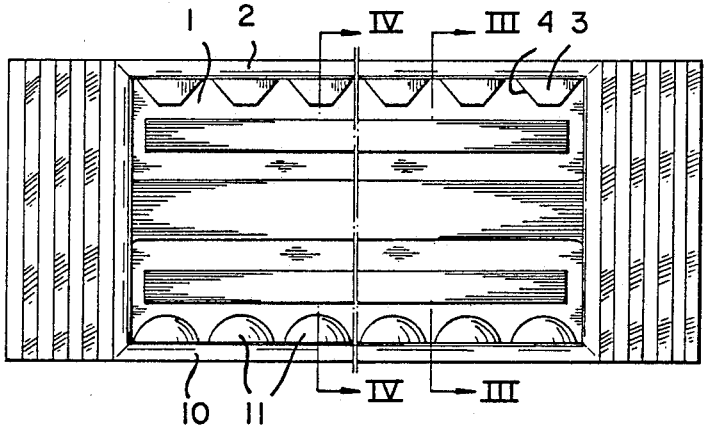
FIG. 2 shows a bottom view of this cover.
Figure 3:
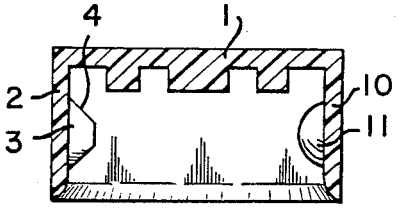
FIG. 3 shows a section according to the line III—III.

The cover 1 shown in FIG. 2 is provided at its lateral surface 2 with knobs 3. The knobs 3 are in the form of a truncated pyramid, the sloping surfaces 4 resting sealingly against the likewise sloping surfaces of the pyramid-shaped apertures of the multipoint connector body 6. A contact 7 is accommodated in the interior of the multipoint connector body 6. This contact is provided with downward-bent connecting pins 8 and 9. It can be seen from FIG. 4 that the lowermost sloping surface of the knob 3 rests sealingly against the connecting pin 8.

Figure 4:
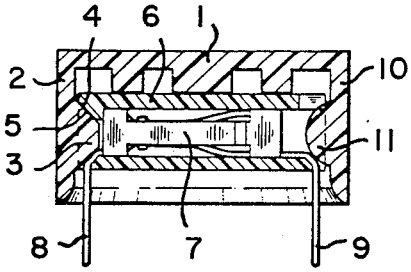
FIG. 4 shows a section along the line IV—IV.

The further lateral surface 10 in the cover 1 is provided with dome-shaped knobs 11 which cover the apertures of the multipoint connector body 6 which are on the right in FIG. 4.

Figure 5B:
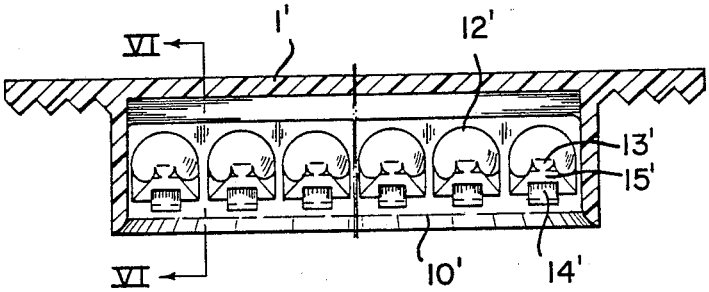
FIGS. 5*a* and 5*b* show sections through two embodiments, respectively.
Figure 6B:
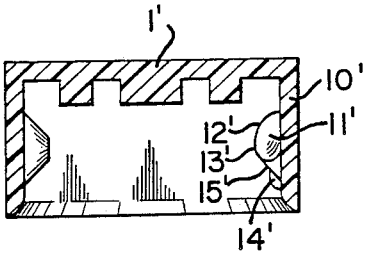
FIGS. 6*a* and 6*b* show sections along the line VI—VI in FIGS. 5*a* and 5*b*, respectively.
Figure 5A:
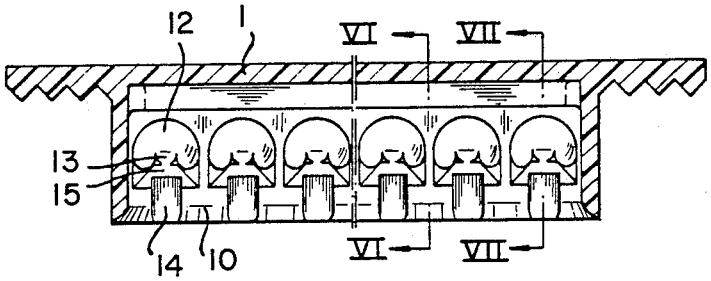
Figure 6A:
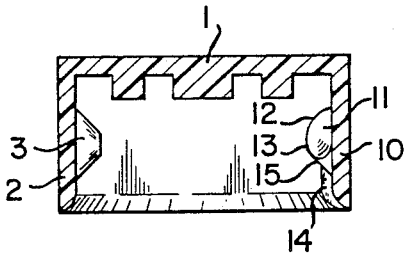
Figure 7:
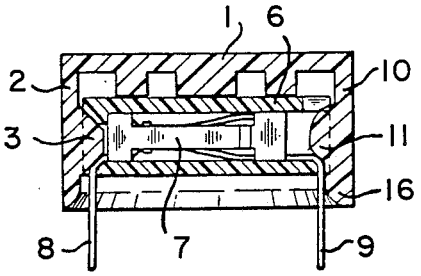
FIG. 7 shows a section through the line VII—VII.

An advantageous embodiment is indicated in FIGS. 5*a*, 6*a* and 7. Here, the dome 12 of the knob is provided with a projection 13 which is lower than the dome. This projection has a trapezoidal cross-section and has been bevelled at its free end at 15. This first projection 13 is provided at its free end with a second projection 14, in which the projection has a curved cross-section.

The depth of the interior of the cover is greater than the corresponding dimension of the multipoint connector body 6. The cover is furthermore rounded at the free end 16. By virtue of the special embodiment of the free end of this cover and the suitably selected depth of the cover, the free end of the cover is bent outwards to a certain extent when the cover is pressed onto a multipoint connector body arranged on a printed circuit board and, as a result, the knob rests against the connecting pin 9 over a surface area which is as great as possible. Thus the sealing is optimum.

An optimum embodiment is shown in FIGS. 5*b* and 6*b*. The second projection 14' does not extend as far as the edge of the cover and is shorter than that 14 in FIGS. 5*a* and 6*a*. With the cover pressed on, the edge of the cover rests clingingly against the circuit board and is not lifted by the projections 14'. Accordingly, the sealing at the edge of the cover is optimum.

The inner surface of the upper part of the cover is in addition provided with longitudinal ribs.

I claim:

1. A cover for a multipoint connector having a block-shaped multipoint connector body with lateral surfaces, said connector having electrical contacts with connecting pins disposed within spaces of the body, said contacts being accessible from the outside through apertures provided in said lateral surfaces of the connector body, said cover comprising an upper part and four lateral parts extending substantially perpendicularly to said upper part to define an open end for the cover into which the connector is received, at least two of said lateral parts having inner surfaces which face the apertures in said lateral surfaces of the multipoint connector body when said cover is inserted over the connector, said inner surfaces being provided with knobs aligned so as to lie opposite each aperture and rest against the edge of each respective aperture when the cover is placed on the connector.

2. A cover according to claim 1, wherein at least one of the apertures of the multipoint connector body having an inner surface decreasing in a pyramid-shape at the edge of said apertures from the lateral surface of the multipoint connector body and wherein the corresponding knob has the shape of a truncated pyramid.

3. A cover according to claim 1, characterized in that the upper part of the cover is at a distance from the open end of the cover which is greater than the height of the multipoint connector body.

4. A cover according to claim 1, characterized in that the lateral parts of the cover have been rounded at their free edge at the open end of the cover.

5. A cover according to claim 1, at least one of the apertures of the multipoint connector body having a rectangular or square cross-section and the connecting pin of the corresponding contact having been bent downwards virtually perpendicularly and lying in a slot in the aperture edge, characterized in that the corresponding knob is dome shaped.

6. A cover according to claim 5, characterized in that the dome-shaped knob is provided with a projection which extends in the direction of the open end of the cover and is disposed below said knob.

7. A cover according to claim 6, characterized in that the projection has a trapezoidal cross-section and has been bevelled at its free end, said projection being provided at its free end with a second projection extending in the direction of the cover opening and having a curved cross-section.

8. A cover according to claim 7, characterized in that the second projection does not extend as far as the edge of the cover open end.

* * * * *